US009031704B2

(12) United States Patent
Tockert et al.

(10) Patent No.: US 9,031,704 B2
(45) **Date of Patent: *May 12, 2015**

(54) METHOD AND SYSTEM FOR ADJUSTING THE FLOW RATE OF CHARGE MATERIAL IN A CHARGING PROCESS OF A SHAFT FURNACE

(75) Inventors: Paul Tockert, Berbourg (LU); Emile Breden, Luxembourg (LU); Emile Lonardi, Bascharage (LU); Damien Meyer, Ennery (FR)

(73) Assignee: Paul Wurth S.A., Luxembourg (LU)

( * ) Notice: Subject to any disclaimer, the term of this patent is extended or adjusted under 35 U.S.C. 154(b) by 771 days.

This patent is subject to a terminal disclaimer.

(21) Appl. No.: 13/148,953

(22) PCT Filed: Feb. 11, 2010

(86) PCT No.: PCT/EP2010/051748

§ 371 (c)(1),
(2), (4) Date: Aug. 11, 2011

(87) PCT Pub. No.: WO2010/092132

PCT Pub. Date: Aug. 19, 2010

(65) Prior Publication Data

US 2011/0311926 A1 Dec. 22, 2011

(30) Foreign Application Priority Data

Feb. 11, 2009 (LU) ..... 91525

(51) Int. Cl.
*F27D 3/00* (2006.01)
*C21B 7/20* (2006.01)
(Continued)

(52) U.S. Cl.
CPC ... *C21B 7/20* (2013.01); *C21B 7/24* (2013.01); *C21B 2300/04* (2013.01); *F27B 1/20* (2013.01);
(Continued)

(58) Field of Classification Search
CPC ..... F27B 1/20; F27B 1/28; F27D 19/00; F27D 2019/0075; F27D 21/00
USPC ..... 432/95–99; 700/282; 222/55
See application file for complete search history.

(56) References Cited

U.S. PATENT DOCUMENTS 3,693,812 A 9/1972 Mahr
3,929,240 A 12/1975 Legille
(Continued)

FOREIGN PATENT DOCUMENTS

EP 0062770 A1 10/1982
EP 0088253 A1 9/1983
(Continued)

OTHER PUBLICATIONS

International Search Report PCT/EP2010/051748; Dated Jun. 16, 2010.

*Primary Examiner* — Gregory Huson
*Assistant Examiner* — Ko-Wei Lin
(74) *Attorney, Agent, or Firm* — Cantor Colburn LLP

(57) ABSTRACT

In a charging process of a shaft furnace, in particular of a blast furnace, batches of charge material are typically discharged in cyclical sequence into the furnace from a top hopper using a flow control valve. A method and system is proposed for adjusting the flow rate of charge material in such a process. Pre-determined valve characteristics for certain types of material are provided, each indicating the relation between flow rate and valve setting for one type of material. According to the invention, a specific valve characteristic is stored for each batch of charge material, each specific valve characteristic being bijectively associated to one batch and indicating the relation between flow rate and valve setting of the flow control valve specifically for the associated batch. In relation to discharging a given batch of the sequence the invention proposes: using the stored specific valve characteristic associated to the given batch for determining a requested valve setting corresponding to a flow rate setpoint and using the requested valve setting to operate the flow control valve; determining an actual average flow rate for the discharge of the given batch; correcting the stored specific valve characteristic associated to the given batch in case of a stipulated deviation between the flow rate setpoint and the actual average flow rate.

13 Claims, 3 Drawing Sheets

(51) Int. Cl.

| | |
|---|---|
| ***C21B 7/24*** | (2006.01) |
| ***F27B 1/20*** | (2006.01) |
| ***F27B 1/28*** | (2006.01) |
| ***F27D 19/00*** | (2006.01) |
| *F27D 21/00* | (2006.01) |
| *F27D 3/10* | (2006.01) |

(52) U.S. Cl.
CPC . *F27B 1/28* (2013.01); *F27D 19/00* (2013.01); *F27D 21/0035* (2013.01); *F27D 2019/0075* (2013.01); *F27D 2019/0087* (2013.01); *F27D 2003/105* (2013.01)

(56) References Cited

U.S. PATENT DOCUMENTS

| | | | | |
|---|---|---|---|---|
| 4,071,166 | A | | 1/1978 | Legille |
| 4,074,816 | A | | 2/1978 | Legille |
| 4,074,835 | A | | 2/1978 | Legille |
| 4,234,102 | A | * | 11/1980 | Spurgeon ..... 222/55 |
| 4,709,117 | A | * | 11/1987 | Gray, Jr. ..... 585/738 |
| 5,196,050 | A | * | 3/1993 | Taniyoshi ..... 75/386 |
| 6,779,569 | B1 | * | 8/2004 | Teer et al. ..... 141/94 |
| 7,107,948 | B2 | * | 9/2006 | Tomii ..... 123/90.15 |
| 8,666,557 | B2 | * | 3/2014 | Tockert et al. ..... 700/282 |
| 2007/0016333 | A1 | * | 1/2007 | Edwards et al. ..... 700/282 |
| 2008/0077335 | A1 | * | 3/2008 | Lee et al. ..... 702/47 |

FOREIGN PATENT DOCUMENTS

| | | | |
|---|---|---|---|
| EP | 0204935 | A1 | 12/1986 |
| EP | 0488318 | A1 | 6/1992 |
| JP | 59229407 | A | 12/1984 |
| JP | 05320729 | A | 12/1993 |
| JP | 09176705 | A | 7/1997 |
| JP | 2005206848 | A | 8/2005 |
| WO | 2007082630 | A1 | 7/2007 |

* cited by examiner

| $\dot{v}$ | $\alpha$ |
|---|---|
| $\dot{v}_1$ | $\alpha_1$ |
| $\dot{v}_2$ | $\alpha_2$ |
| ⋮ | ⋮ |
| $\dot{v}_i$ | $\alpha_i$ |
| $\dot{v}_{i+1}$ | $\alpha_{i+1}$ |
| ⋮ | ⋮ |
| $\dot{v}_{N-1}$ | $\alpha_{N-1}$ |
| $\dot{v}_N$ | $\alpha_N$ |
Fig. 4
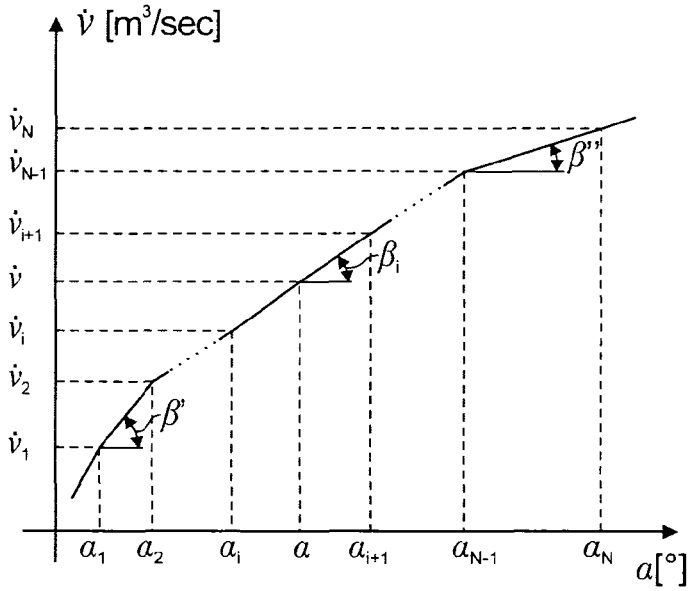
Fig. 5
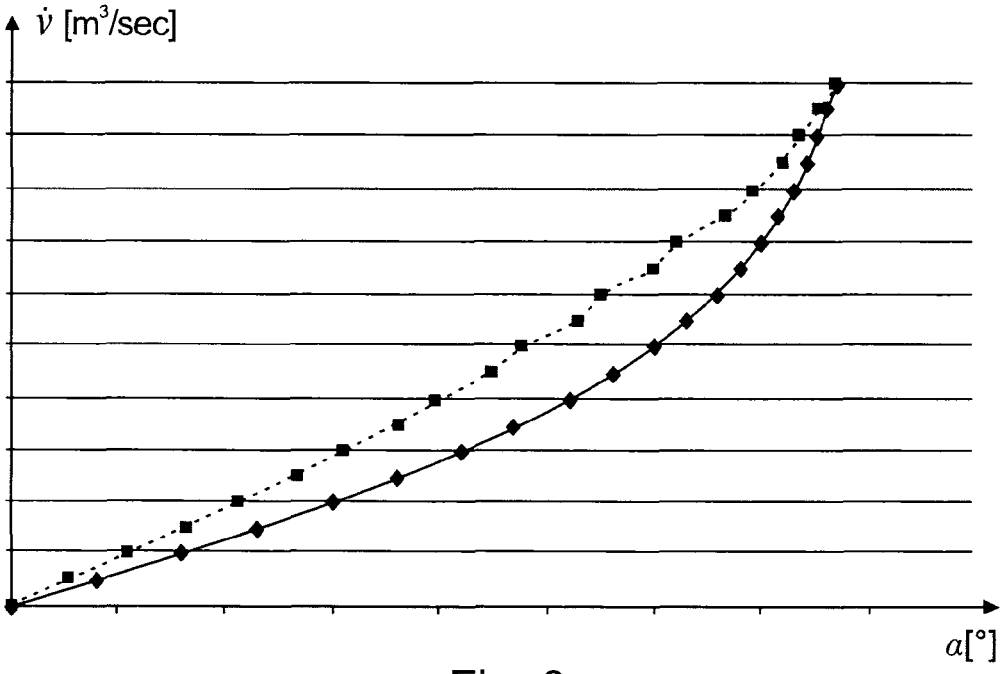
Fig. 6

METHOD AND SYSTEM FOR ADJUSTING THE FLOW RATE OF CHARGE MATERIAL IN A CHARGING PROCESS OF A SHAFT FURNACE

TECHNICAL FIELD

The present invention generally relates to the charging process of a shaft furnace, in particular a blast furnace. More specifically, the present invention relates to a method and a system for adjusting the flow rate of charge material from a top hopper into the furnace using a flow control valve.

BACKGROUND

It is well known that, besides proper burdening of materials, the geometrical distribution of charge material in a blast furnace has a decisive influence on the hot metal production process since it determines among others the gas distribution. In order to achieve a desired distribution profile in view of an optimal process, two basic aspects are of importance. Firstly, material is to be directed to the appropriate geometric locus on the stock-line for achieving a desired pattern, typically a series of closed concentric rings or a spiral. Secondly, the appropriate amount of charge material per unit surface is to be charged over the pattern.

Regarding the first aspect, geometrically well-targeted distribution can be achieved using a top charging installation equipped with a distribution chute that is rotatable about the furnace axis and pivotable about an axis perpendicular to the rotational axis. During the last decades, this type of charging installation commonly referred to as BELL LESS TOP™ has found widespread use throughout the industry among others because it allows directing charge material accurately to any point of the stock-line by appropriate adjustment of the chute rotation and pivoting angles. An early example of such a charging installation is disclosed in U.S. Pat. No. 3,693,812 assigned to PAUL WURTH. In practice, this kind of installation is used to discharge cyclically recurring sequences of charge material batches into the furnace by means of the distribution chute. The distribution chute is typically fed from one or more top hoppers (also called material hoppers) arranged at the furnace top upstream of the chute, which provide intermediate storage for each batch and serve as a furnace gas sluice.

In view of the second aspect, i.e. controlling the amount of material charged per unit surface area, the above-mentioned type of charging installation is commonly equipped with a respective flow control valve (also called material gate) for each top hopper, e.g. according to U.S. Pat. No. 4,074,835. The flow control valve is used for adjusting the flow rate of charge material discharged from the respective hopper into the furnace via the distribution chute to obtain the appropriate amount of charge material per unit surface by means of a variable valve opening.

Flow rate adjustment usually aims at obtaining a diametrically symmetrical and circumferentially uniform weight distribution over the desired pattern, which typically requires a constant flow rate. Another important aim is to synchronize the end of a batch discharge with respect to the end of the pattern described by the distribution chute. Otherwise, the hopper may be emptied before the chute reaches the end of the pattern ("undershoot") or there may remain material to be discharged after the pattern has been fully described by the chute ("overshoot").

In a known approach, the flow control valve is initially set to a predetermined "average" position i.e. "average" valve opening corresponding to an average flow rate. In practice, the average flow rate is determined in function of the initial volume of the batch stored in the respective top hopper and the time required by the distribution chute for completely describing the desired pattern. The corresponding valve opening is normally derived from one of a set of pre-determined theoretical valve characteristics for different types of material, especially from curves plotting flow rate against valve opening for different types of material. As discussed e.g. in European patent no. EP 0 204 935 a valve characteristic for a given type of material and a given valve may be obtained by experiment. EP 0 204 935 proposes regulating the flow rate by means of "on-line" feedback control during the discharge of a batch in function of the monitored residual weight or weight change of charge material in the discharging top hopper. In contrast to earlier U.S. Pat. Nos. 4,074,816 and 3,929,240, EP 0 204 935 proposes a method which, starting with a predetermined average valve opening, increases the valve opening in case of insufficient flow rate but does not reduce the valve opening in case of excessive flow rate. EP 0 204 935 also proposes updating data indicating the valve position required to ensure a certain output of a particular type of material, i.e. the valve characteristic for a particular type of material, in the light of results obtained from previous charging.

European patent EP 0 488 318, discloses another method of flow rate regulation by means of real time control of the degree of opening of the flow control valve and also suggests the use of tables that represent the relationship between the degree of opening and the flow rate according to different kinds of material akin to the above-mentioned valve characteristic. EP 0 488 318 proposes a method aiming at obtaining a constant ratio of flow rate to (average) grain diameter during the discharge in view of achieving a more uniform gas flow distribution. Because obtaining accurate valve characteristics for different material types from theoretical formula is difficult, EP 0 488 318 further proposes a statistical correction of the material-type based tables in a least square method using the flow rates actually achieved at a given valve opening during subsequent batch discharges.

Japanese patent application JP 2005 206848 discloses another method of "on-line" feedback control of the valve opening during the time of discharge of a batch. In addition to readjusting the valve opening during a discharge by means of a "dynamic control", JP 2005 206848 proposes applying two calculations, a "feed forward" correction and a "feed back" correction to a valve opening derived from a standard opening function, which approximates a valve characteristic based on values of flow rate and valve opening stored for different material types. In similar manner, patent application JP 59 229407 proposes a control device that stores relationships of valve opening to discharge time (akin to characteristics) for different material types and applies a correction term to the valve opening derived from the stored relationships. Contrary to EP 0 488 318 however, JP 2005 206848 and JP 59 229407 do not suggest correction of the stored values.

The practice of "on-line" flow regulation according to EP 0 204 935 is currently widespread. Despite its obvious benefits regarding circumferentially uniform weight distribution, this approach leaves room for improvement, among others because it requires a rather complex control system. Moreover, it has been found that known approaches are not sufficiently adaptive and, under certain circumstances, may lead to unsatisfactory results, especially in case of variations in batch properties and in case of batches consisting of a mixture of different charge materials.

BRIEF SUMMARY

The invention provides both a simplified method and simplified system for adjusting the flow rate of charge material, which reliably adapt to a variety of batch properties and variations thereof during the charging procedure.

The present invention relates to a method of adjusting the flow rate of charge material in a charging process of a shaft furnace, in particular of a blast furnace. Such charging process typically involves a cyclic succession of batches of charge material, which form a charging-cycle. As will be understood, a batch thus represents a given quantity or lot of charge material, e.g. one hopper filling or load, to be charged into the furnace in one of the several operations that constitute a charging-cycle. The batches are discharged into the furnace from a top hopper using a flow control valve. The latter valve is associated to the top hopper for controlling the flow rate of charge material. Pre-determined valve characteristics are preferably provided for certain types of material. Each predetermined characteristic indicates the relation between flow rate and valve setting of the considered flow control valve as pertaining to a certain material type.

The proposed method provides a specific valve characteristic for each batch of charge material respectively as well as for each flow control valve in case of a multiple-hopper charging installation. Each such specific valve characteristic is bijectively associated to a different batch of the charging-cycle. Hence, each of the latter characteristics is specific to a particular batch according to a one-by-one relationship. Each of them thus indicates the relation between flow rate and valve setting of the considered flow control valve for the associated batch. In order to initially obtain such specific characteristics, the specific valve characteristic are preferably initialized to reflect one of the aforesaid pre-determined valve characteristics, which is for instance chosen in accordance with a predominant type of material contained in the associated batch. The method further comprises in relation to discharging a given batch of the charging-cycle from the top hopper:

- using the stored specific valve characteristic associated to the given batch for determining a requested valve setting corresponding to a flow rate setpoint and using this requested valve setting to operate the flow control valve;
- determining an actual average flow rate at which the given batch has been discharged; and
- correcting the stored specific valve characteristic associated to the given batch in case of a stipulated deviation between the flow rate setpoint and the actual average flow rate.

In other words, a valve characteristic specific to each batch (and each control valve) is provided and corrected as often as required in function of the actual flow rate at which an instance of the batch in question was discharged. These specific valve characteristics are thus caused to match more and more closely the true valve characteristic that applies to the discharge of the batch in question. They thereby adapt automatically to any batch-inherent properties that influence the flow rate (material mixtures, granularity, total weight, humidity, . . . ) during discharge. Using valve settings derived from the progressively corrected specific valve characteristics will thus gradually adjust the flow rate to the desired flow rate setpoint. Moreover, as opposed to known adjustment methods, in which flow rate control for different batches of the same material type in a charging cycle relies on one and the same predetermined valve characteristic for this material type, the proposed method automatically adapts to differences in the top charging parameters of different batches of the same type, for instance to closure of the flow control valve between different chute pivoting positions. As will be appreciated, compared to the known approach of providing only a limited number of characteristics for each different type of material (e.g. agglomerated fines, coke, pellets, or ore) respectively, the presently proposed solution is particularly beneficial when charging one or more batches that comprise a mixture of different material types.

A corresponding system for adjusting the flow rate is proposed in claim 7. In accordance with the invention, the system mainly comprises memory means storing the specific valve characteristics and a suitable programmable computing means (e.g. a computer or PLC) programmed to perform the key aspects of the proposed method as itemized above.

Preferred features of the proposed method and system are defined in dependent claims 2-6 and 8-12 respectively.

BRIEF DESCRIPTION OF THE DRAWINGS

A preferred embodiment of the invention will now be described, by way of example, with reference to the accompanying drawings in which:

FIG. 4 is a table of a specific valve characteristic expressed as a sequence of discrete valve setting values (opening angle $\alpha$ of FIG. 1) and an associated sequence of discrete average flow rate values;

FIG. 5 is a graph of a curve illustrating the specific valve characteristic of FIG. 4;

FIG. 6 is graph of curves illustrating an initial specific valve characteristic (solid line) and a corrected specific valve characteristic (broken line).

DETAILED DESCRIPTION

Figure 1:
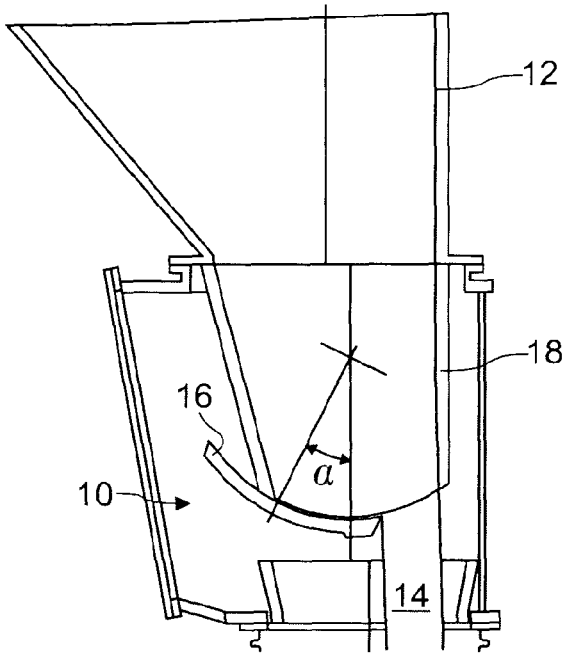
FIG. 1 is a schematic vertical cross sectional view of a flow control valve associated to a top hopper of a blast furnace charging installation.

FIG. 1 schematically illustrates a flow control valve 10 at the outlet of a top hopper 12 in a blast furnace top charging installation, e.g. according to PCT application no. WO 2007/082630. During batchwise discharge of charge material, the flow control valve 10 is used to control the (mass or volumetric) flow rate. As is well known, for a proper charging profile, the flow rate has to be coordinated with the operation of a distribution device to which material is fed in form of a flow 14 as illustrated in FIG. 1. Typically, the flow rate is to be coordinated with the operation of a rotating and pivoting distribution chute (not shown). As will be understood, the flow rate is a process variable determined primarily by the valve opening (aperture area/open cross-section) of the valve 10.

In the embodiment illustrated in FIG. 1, the flow control valve 10 is configured according to the general principles of U.S. Pat. No. 4,074,835, i.e. with a pivotable throttling shutter 16 slewing in front of a channel member 18 of generally octagonal or oval cross-section. In this embodiment, the controllable valve setting (manipulated variable) is the opening angle $\alpha$ of the valve 10 which determines the pivotal position of the shutter 16 and thereby the valve opening. Hereinafter the symbol "$\alpha$" is expressed e.g. in [°] and represents the valve setting for the valve 10 of FIG. 1 merely for the purpose of illustration. In fact, the present invention is not limited in its application to a specific type of flow control valve. It is equally applicable to any other suitable design such as those disclosed in European patent no. EP 0 088 253, in which the manipulated variable is the axial displacement of a plug-type valve, or in European patent no. EP 0 062 770, in which the manipulated variable is the aperture of an iris-diaphragm-type valve.

Figure 2:
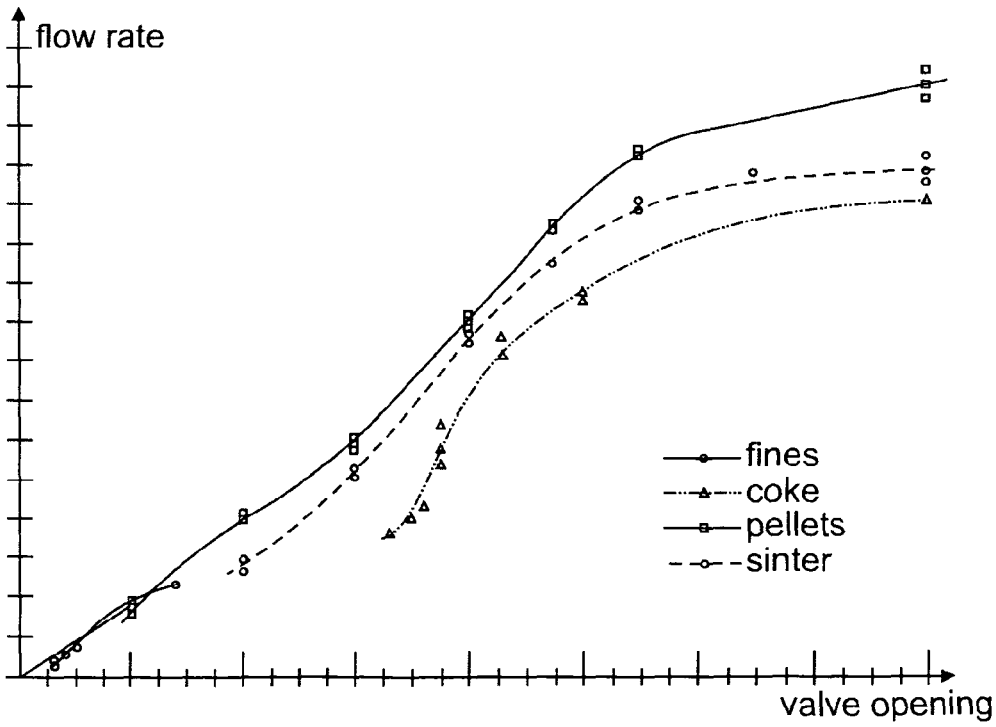
FIG. 2 is a graph illustrating a family of pre-determined characteristic curves plotting flow rate against valve setting as determined by measurement for different types of material and a specific flow control valve.

FIG. 2 illustrates curves plotting flow rate against valve setting for different types of material respectively, namely agglomerated fines, coke, pellets and ore, for a given type of flow control valve (the curves of FIG. 2 are of a plug-type flow control valve of the type as disclosed in EP 088 253). Each curve is obtained empirically in known manner, i.e. based on flow rate measurements for different valve settings using a representative batch of a given material type having typical properties, in particular granulometry and total batch weight. Curves as illustrated in FIG. 2 thus express a pre-determined generic valve characteristic pertaining to a certain material type.

Hereinafter, the flow rate adjustment according to the present invention will be described with reference to FIGS. 3-6.

Figure 3:
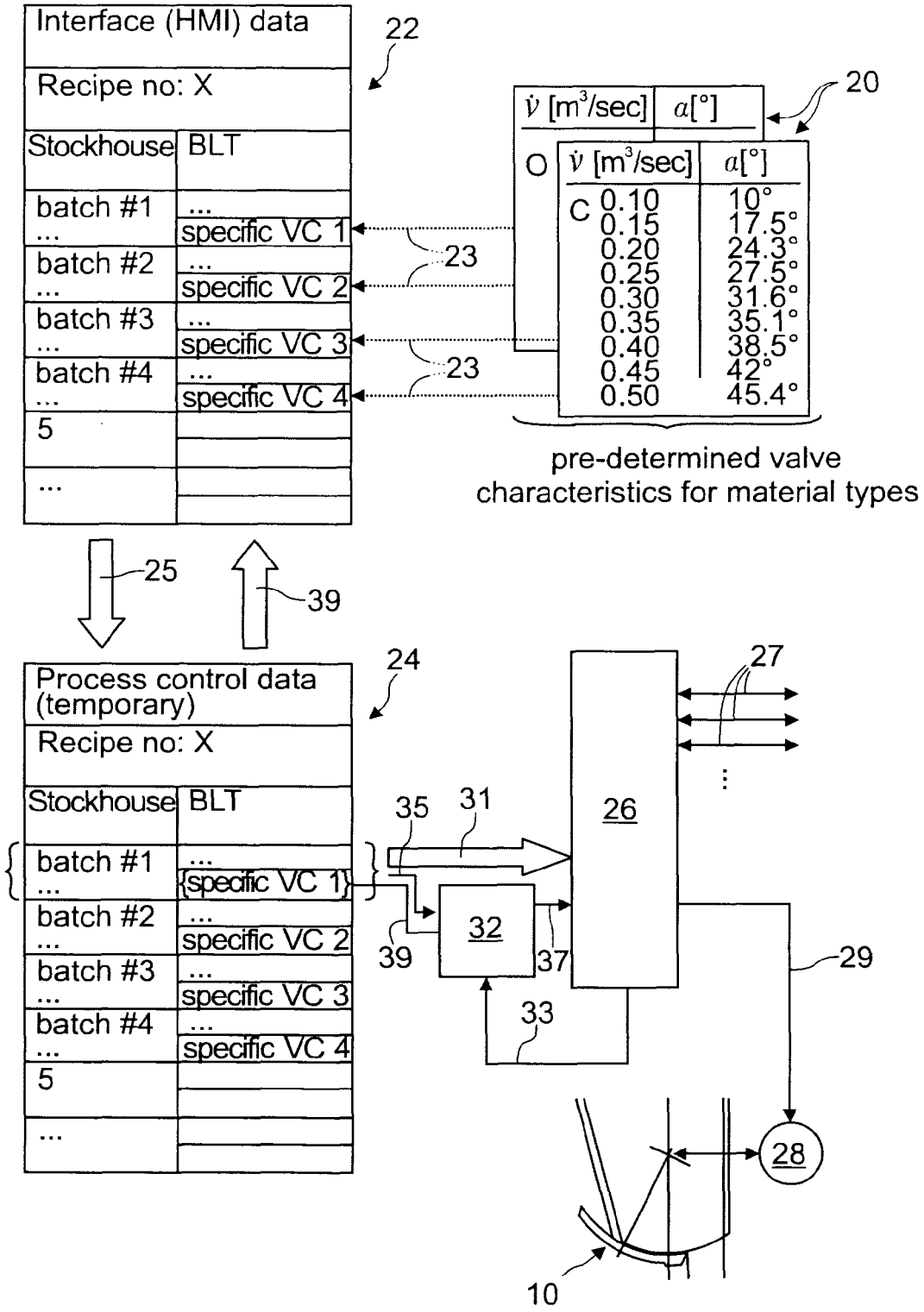
FIG. 3 is a flow chart schematically illustrating data flow in connection with adjusting the flow rate according the present invention.

As illustrated in FIG. 3, a limited number of pre-determined valve characteristics 20 are provided to indicate the relationship between flow rate and valve setting of the flow control valve 10 as pertaining to a certain type of material. For instance, only two master characteristics, one for coke type material ("C") and one for ferrous type material ("O"), are provided as shown in FIG. 3 although further possible pre-determined characteristics, e.g. for sinter type material and pellets type material respectively (see FIG. 2), are not excluded. Pre-determined valve characteristics 20 are provided in accordance with the material types used in a desired charging-cycle and obtained in known manner, e.g. as set out above in relation to FIG. 2. The pre-determined characteristics 20 are stored in any suitable format in a data storage device, e.g. a hard disk of a computer system implementing a human-machine-interface (HMI) for user interaction with the process control of the blast furnace charging operation or in retentive memory of a programmable logic controller (PLC) of the process control system.

FIG. 3 further illustrates a diagram of a first data structure 22 labeled "Interface (HMI) data" comprising data items related to process control of the charging process. The data structure 22 is used in the HMI and holds a current set of user-specified settings and parameters, i.e. a "recipe" for control of the charging process. It may have any appropriate format to contain data (" . . . " in column "BLT") suitable for process control of the charging installation, e.g. for choosing the desired charging pattern, and (" . . . " in column "Stockhouse") for process control of an automated stockhouse, e.g. for supplying the desired weight, material composition and arrangement of the batches. For each batch a respective data record is provided as illustrated by rows in the tabular representation of the data structure 22 in FIG. 3 (see identifier "batch #1" . . . "batch #4"). For the purpose of stockhouse control, each batch data record includes at least data indicative of the material composition of the batch to which the data record is associated. For the purposes of the present, the expression "record" refers to any number of related items of information handled as a unit, irrespectively of any specific data structure (i.e. does not necessarily imply use of a database).

As illustrated in FIG. 3, a specific valve characteristic "specific VC1"; "specific VC2", "specific VC3", "specific VC4" is stored for each batch so that a respective specific valve characteristic is dedicated i.e. bijectively associated to each batch. Like the pre-determined characteristics 20, each specific valve characteristic also indicates the relation between flow rate and valve setting. More specifically, each specific characteristic "specific VC1" . . . "specific VC4" expresses a relationship between an average flow rate value and the manipulation input used as setting for controlling the flow control valve 10. In fact, due to wear of the valve shutter 16 the actual valve opening may vary for a same valve setting $\alpha$ during lifetime of the flow control valve 10.

As will be understood, instead of pertaining to a certain type of material, each of the valve characteristics "specific VC1" . . . "specific VC4" is specific to one batch i.e. it expresses the aforesaid relationship for the one particular batch to which it is associated. This bijection can be implemented in simple manner by storing a specific valve characteristic as a data item of the respective data record "batch #1" . . . "batch #4" existing for the associated batch in an embodiment as illustrated in FIG. 3. Other suitable ways of storing the specific valve characteristics (e.g. in a separate data structure) are of course within the scope of the invention. As further illustrated by arrows 23 in FIG. 3, when batch data is created (e.g. by user-entry) each specific valve characteristic "specific VC1" "specific VC4" is initialized to reflect one of the pre-determined valve characteristics ("O"/"C"), which is preferably chosen in accordance with a predominant type of material contained in the batch in question. The latter information can be derived from stockhouse control data of the data record "batch #1" . . . "batch #4", which as stated includes at least data indicative of the material composition. If compatible formats are used (see below) the specific valve characteristics "specific VC1" . . . "specific VC4" may simply be initialized as copies of the appropriate pre-determined valve characteristic 20. As will be noted, initialization as illustrated by arrows 23 is only required once, namely before the "recipe" reflected by the contents of the data structure 22 is put into production for the first time i.e. when no earlier specific valve characteristics are available (see below).

As further seen in FIG. 3, a temporary second data structure 24, labeled "Process control data", is derived from the first data structure 22 in a step illustrated by arrow 25. Depending on design particularities of the HMI and process control system to be used, the second data structure 24 may be initialized as an identical or similar copy of the first data structure 22 and is stored in data memory, typically non-retentive memory, of a programmable computing device, e.g. a PC type computer system implementing the HMI, a local server or a PLC of a process control system. The content of the data structure 24 is used as "working copy" for actual process control purposes. Similar to the first data structure 22, the second data structure 24 includes several data records "batch #1" . . . "batch #4", each defining properties of a batch to be charged and furnace top charging parameters (column "BLT") including a dedicated specific valve characteristic "specific VC1" . . . "specific VC4" for each defined batch (illustrated by a gray-shaded row in the tabular representation of FIG. 3).

FIG. 3 schematically illustrates a process control system 26 of known architecture, e.g. a network of PLCs connected to an appropriate server. In known manner, the process control system 26 communicates with the automation components of the stockhouse (e.g. weighing bins, weighing hoppers, extractors, conveyors, etc.) and the top charging installation (e.g. drive unit of a rotatable and pivotable distribution chute, hopper sealing valves, weighing equipment, etc.) as indicated by arrows 27. As illustrated by FIG. 3, the process control system 26 controls the flow control valve 10, typically via an associated valve controller 28. Hence, as illustrated schematically by arrow 29, the process control system 26 provides the manipulation input used as setting for controlling the flow control valve 10 by the controller 28.

In a step illustrated by arrow 31, relevant data required for process control is derived from a data record e.g. "batch #1" of the temporary data structure 24 as illustrated in FIG. 3 and provided to the process control system 26. To this effect, the second data structure 24 may be stored in a memory external to the process control system 26 or internal to the latter, e.g. within a PLC of the process control system 26 itself.

In relation to flow rate adjustment on the basis of a specific valve characteristic and for discharging a given batch, e.g. in accordance with data record "batch #1" as illustrated in FIG. 3, the following data processing steps are carried out:

a) determining a flow rate setpoint (prior to discharge);

b) deriving a requested valve setting that corresponds to the flow rate setpoint from the appropriate specific valve characteristic (prior to discharge);

c) determining an actual average flow rate at which the given batch was discharged (after discharge);

d) correcting the stored specific valve characteristic associated to the given batch if appropriate, i.e. in case of a stipulated deviation between the flow rate setpoint and the determined actual average flow rate (after discharge).

The above step d) is preferably performed by a software module 32 implemented on the computer system that provides the HMI. The above steps a) to c) are preferably implemented on an existing process control system 26 as illustrated in FIG. 3. Other implementations of steps a) to d) on either the process control system 26 or the HMI computer system or distributed on both are also within the scope of the present disclosure.

The module 32 operates in particular on the specific valve characteristic of the given batch to be discharged. To this effect, the specific valve characteristics "specific VC1" . . . "specific VC4" may have any appropriate format in terms of data structure. They may be stored in the form of an ordered e.g. array-type collection of pairs of flow rate values and valve setting values ($\dot{V}_i;\alpha_i$) representing a discretization that approximates a true characteristic curve. In even simpler form, instead of storing both values of a pair, it may suffice to store a singleton sequence (ordered list) of valve setting values $\alpha_i$ (right hand column of tabular representation in FIG. 4) as discrete points or samples taken at fixed flow rate intervals $\delta\dot{V}=\dot{V}_{i+1}-\dot{V}_i$ or vice-versa since the sequence index i allows determining the corresponding fixed-interval sequence. For the purpose of illustration, the specific valve characteristics are hereinafter considered in the form of an indexed array of pairs ($\dot{V}_i;\alpha_i$) as illustrated in FIG. 4, in which the flow rate is expressed in fixed steps $\delta\dot{V}=\dot{V}_{i+1}-\dot{V}_i$. e.g. of 0.05 $m^3/s$, while other suitable forms of digitizing a characteristic are considered to be within the scope of the invention.

Preferred embodiments of the above steps a) to d) are as follows:

a) Determining the Flow Rate Setpoint

Before discharging a given batch, a flow rate setpoint $\dot{V}_S$ is calculated, typically by dividing the net weight of the batch by the targeted total batch discharging time, the result multiplied by the average density of this batch (for volumetric flow rates). The net weight is typically determined using suitable hopper weighing equipment, e.g. as disclosed in U.S. Pat. No. 4,071,166 and U.S. Pat. No. 4,074,816. The process control system 26, to which the weighing equipment is connected, inputs the weighing results or the calculated flow rate set point to the module 32 as illustrated by arrow 33. The targeted discharging time corresponds to the time required by the distribution device to complete the desired charging pattern. This time is pre-determined by calculation, e.g. in function of the length of the desired charging pattern and the chute motion speed. Targeted discharging time and average density are included as a data item in the respective record, e.g. "batch #1", of the temporary data structure 24, and input to the control system 26 according to arrow 31 or to the module 32 according to arrow 35 depending on where step a) is implemented.

b) Deriving the Requested Valve Setting from the Specific Valve Characteristic

For discharging a given batch, the associated specific valve characteristic, e.g. "specific VC1" for "batch #1" in FIG. 3, as currently stored is input to the module 32 according to arrow 35. Having determined the flow rate setpoint (see section a) above), the requested valve setting a that corresponds to the flow rate setpoint $\dot{V}_S$ is derived from the specific valve characteristic of the given batch by linear interpolation as best illustrated in FIGS. 4-5.

More specifically, the adjacent flow rate values $\dot{V}_i;\dot{V}_{i+1}$ in the specific valve characteristic between which the flow rate setpoint $\dot{V}_S$ is comprised are determined according to inequality:

$$\dot{V}_i \leq \dot{V}_S < \dot{V}_{i+1} \tag{1}$$

and used, in conjunction with their associated valve setting values $\alpha_i;\alpha_{i+1}$ for interpolation of the requested valve setting value $\alpha$ according to equation:

$$\alpha = \alpha_i + \left(\dot{V}_S - \dot{V}_i\right) \cdot \frac{\alpha_{i+1} - \alpha_i}{\dot{V}_{i+1} - \dot{V}_i} \tag{2}$$

with i determined such that $\alpha_i \leq \alpha < \alpha_{i+1}$.

For example, with the values in as illustrated in FIG. 3 (for pre-determined valve characteristic "C") and rounding the result to a precision of 0.1°, the requested opening angle as valve setting for a flow rate setpoint of 0.29 $m^3/s$ according to equation (2) is $\alpha$=29.5°.

Before starting the discharge of the given batch, the module 32 outputs the requested valve setting $\alpha$ determined according to equation (2) to the process control system 26 as illustrated by arrow 37. The process control system 32 in turn outputs the requested valve setting $\alpha$ in form of a suitable signal as manipulation input (valve control setpoint) to the controller 28 to operate the control valve 10 (see arrow 29).

c) Deriving the Actual Average Flow Rate

After the given batch has been discharged, the actual time required for the discharge is known (e.g. by means of the weighing equipment or other suitable sensors such as vibration transmitters) so that, similar to determining the flow rate setpoint, the actual average flow rate at which the given batch was discharged can be determined according to:

$$\dot{V}_{real} = \frac{W \cdot \rho_{avg}}{t_{real}} \tag{3}$$

with $\dot{V}_{real}$ being the actual average flow rate, W being the total net batch weight, e.g. as obtained from the weighing equipment connected to the process control system 26, $\rho_{avg}$ being the average batch density (e.g. obtained from the data record according to arrow 35) and $t_{real}$ the time that discharging the given batch actually took. The result $\dot{V}_{real}$ is input to the module 32 according to arrow 33 if step c) is implemented on the process control system.

d) Correcting the Specific Valve Characteristic Associated to the Given Batch

After the batch has been completely discharged, the actual average flow rate $\dot{V}_{real}$ is compared with the flow rate setpoint $\dot{V}_S$. In case of a stipulated deviation (control variance) between them, a correction of the specific valve characteristic is considered necessary in order to gradually minimize such deviation over subsequent discharges of identical batches, e.g. according to data record batch #1. In other words, such correction causes gradual adjustment of the flow rate to the desired setpoint. Such correction is the main function of the module 32 and is preferably carried out as follows:

The difference between the flow rate setpoint and the actual flow rate is calculated according to:

$$\Delta\dot{V}=\dot{V}_S-\dot{V}_{real} \tag{4}$$

A stipulated deviation is considered to have occurred in case the absolute value of the resulting difference according to (4) satisfies the inequality:

$$T_1\cdot\dot{V}_S>|\Delta\dot{V}|>T_2\cdot\dot{V}_S \tag{5}$$

with $T_1$ being a maximum tolerance factor used to set the maximum deviation beyond which no correction is performed and $T_2$ being a minimum tolerance factor used to set the minimal deviation required to perform a correction of the specific valve characteristic. In case of a deviation $|\Delta\dot{V}|>T_1\cdot\dot{V}_S$ an alarm is preferably generated by the HMI to indicate abnormal conditions. Suitable values may be e.g. $T_1=0.2$ and $T_2=0.02$.

Although correcting the flow rate values and maintaining valve setting values (as sampling intervals) is theoretically possible, it is considered preferred to perform correction on the valve setting values while maintaining unchanged flow rate values. Furthermore, for maintaining a consistent characteristic, correction is preferably performed by adjusting each and every of the individual valve setting values $\alpha_i$ of the sequence by applying a respective correction term to each valve setting values $\alpha_i$. The respective correction term is preferably determined using a function chosen to increase with the actual deviation $\Delta\dot{V}$ and to decrease with the difference, preferably with the distance in terms of sequence index, between the valve setting value to be corrected and the valve setting value that approximates or is equal to the requested valve setting value. Accordingly, the magnitude of the correction term will vary in accordance with $\Delta\dot{V}$ while it will be smaller the more "remote" the setting value to be corrected is from the requested valve setting $\alpha$ as determined e.g. by equation (2). In a preferred embodiment this correction term is determined as follows:

For the requested valve setting $\alpha$, the corrected valve setting value that would have been required to achieve the requested flow rate setpoint is:

$$\alpha' = \alpha + \Delta\alpha \tag{6}$$

with $$\Delta\alpha = \Delta\dot{V}\cdot\frac{\alpha_{i+1}-\alpha_i}{\dot{V}_{i+1}-\dot{V}_i} \tag{7}$$

using the notations of equations (2) and (4).

Accordingly, a respective correction term $C_n$ for each of the valve setting values $\alpha_n$ respectively is determined as follows:

$$C_n = \begin{cases} \frac{\Delta\alpha_n}{K_1}\cdot\left(\frac{N-n}{N-i-1}\right), & \alpha_n > \alpha,\ n > i \\ \frac{\Delta\alpha_n}{K_1}\cdot\left(\frac{n-1}{i-1}\right), & \alpha_n \le \alpha,\ n \le i \end{cases} \tag{8}$$

with $$\Delta\alpha_n = \Delta\dot{V}\cdot\frac{\alpha_{n+1}-\alpha_n}{\dot{V}_{n+1}-\dot{V}_n} \tag{9}$$

The respective correction term $C_n$ resulting from equation (8) is then applied to each valve setting of the given specific valve characteristic:

$$\alpha_n'=\alpha_n+C_n;\ n=1\ldots N \tag{10}$$

where $\alpha_n'$ is the corrected valve setting value, $\alpha_n$ is the currently considered (uncorrected) valve setting value in the sequence, $\dot{V}_n$ is the corresponding average flow rate according to the current (uncorrected) characteristic, i identifies the sequence index such that $\alpha_i\le\alpha<\alpha_{i+1}$, N is the total number of values in the specific valve characteristic (sequence length), n is the sequence index (position in the sequence according to the table of FIG. 4) and $K_1$ is a user-defined constant gain factor that allows to prevent overcorrection (instability) by limiting the correction term $C_n$, with preferred values being $5\ge K_1\ge 2$.

Correction is preferably limited according to:

$$\alpha_n' = \begin{cases} \alpha_{min}, & \alpha_n + C_n < \alpha_{min} \\ \alpha_n + C_n, & \alpha_{min} \le \alpha_n + C_n \le \alpha_{max} \\ \alpha_{max}, & \alpha_n + C_n > \alpha_{max} \end{cases} \tag{11}$$

with $\alpha_{min}$ and $\alpha_{max}$ being the minimum and maximum allowable valve settings respectively. As will be understood, other suitable functions may be used for computing a correction term $C_n$ the magnitude of which increases with an increasing actual deviation $\Delta\dot{V}$ and decreases with an increasing difference between the valve setting to be corrected $\alpha_n$ and the requested valve setting $\alpha$.

In a further step, the module 32 preferably ensures that the sequence of valve setting values is strictly monotonically increasing, e.g. by running a program code sequence as follows (in pseudo-code):

```
FOR j=1 to N−1
    WHILE α'j+1 ≤ α'j THEN
        α'j+1 = α'j + 0.1°
    WEND
NEXT j
```

whereby any valve setting value that is less than or equal to the valve setting value that precedes in sequence is incremented until a strict monotonically increase is reached so as to ensure a positive slope of the characteristic curve.

After completion of the computations, the module 32 corrects each of the valve setting values of the specific valve characteristic under consideration by replacing $\alpha_n$ with $\alpha_n'$ for n=1 . . . N. FIG. 6 illustrates a possible result of correction as set out above with a solid-lined curve representing the initial uncorrected specific valve characteristic and a broken-lined curve representing the corrected specific valve characteristic, based on pairs of flow rate values and valve setting values $(\dot{V}_i;\alpha_i)$.

An exemplary program sequence in pseudo-code for performing the above correction calculations is as follows:

```
SEQUENCE
Characteristic flow curve correction
--before discharging--
"Find index below value in characteristic curve"
IF V̇_SP ≠"" ("Flowrate setpoint ≠ "" ") THEN
    α = GetAlpha(V̇_SP)
    MaterialGateSP = α
    LastFlow = Flowrate setpoint
    Flowrate setpoint = ""
ELSE
    MaterialGateSP = ""
END IF
--after discharging--
IF BLT results transmitted = 1 THEN
    ΔV̇ = V̇_Last − V̇_actualmeasured
    N = Number_of_rows_of_characterisitc_curve
    "Do correction if error is beyond tolerance"
    IF |ΔV̇| >T_1 · V_Last AND |ΔV̇| ≤ T_2 · V_Last THEN
        FOR n = 1 TO N
            IF n = 1 THEN
                Corrected curve values = 0
            ELSE
                IF n > i AND n ≠ 1 THEN

                    Δα = ΔV̇ · (α_n − α_{n−1}) / (V̇_n − V̇_{n−1})

                    Correctedcurve_n = α_n + (Δα / K_1) · (N − n) / (N − i − 1)

                ELSE

                    Δα = ΔV̇ · (α_{curve,n} − α_{curve,n−1}) / (V̇_{curve,n} − V̇_{curve,n−1})

                    Correctedcurve_n = α_{curve,n} + (Δα / K_1) · (n − 1) / (i − 1)

                END IF
            END IF
        NEXT n
        "to avoid negative inclination of the corrected characteristic curve"
        FOR n = 2 TO N
            WHILE Correctedcurve_n − Correctedcurve_{n−1} < 0
                    Correctedcurve_n = Correctedcurve_n + 0,1
            WEND
        NEXT n
    ELSE IF |ΔV̇| > T_2 · V_Last THEN
        RETURN MESSAGE "Flow rate difference too big -> no
        correction"
    ELSE
        RETURN MESSAGE "Flow rate difference too small -> no
        correction"
    END IF
    BLT results transmitted = ""
ELSE
    Exit SEQUENCE
END IF
FUNCTIONS
Function GetAlpha(V̇)
i = 1
IF V̇ <> 0 THEN
    WHILE V̇_i < V̇ "Flow rate with index i of the characteristic curve
    <Flow rate setpoint"
        i = i + 1
    WEND
    i = i − 1

    GetAlpha = α_i + (V̇ − V̇_i) · (α_{i+1} − α_i) / (V̇_{i+1} − V̇_i)

END IF
End Function
```

After a correction has been made, the module 32 returns the resulting corrected specific valve characteristic as illustrated by arrow 39 in FIG. 3. This output is used for updating the specific valve characteristic currently stored for the batch in question, e.g. "specific VC 1" for batch #1. By repeating the above procedure for each batch of a charging cycle and at each discharge respectively, the respective flow rate is gradually (after each discharge) adjusted to the desired flow rate setpoint. Furthermore, using the updated specific valve characteristic in the data structure 24, the corresponding specific valve characteristic stored in the HMI data structure 22 as identified using the batch identifier ("batch #1") and recipe identifier ("recipe no: X") is also updated, as illustrated by arrow 41 in FIG. 3. Thereby, flow rate deviations are reduced or eliminated at future uses of the same "recipe" (there being no future initialization according to arrows 23 once an update according to arrow 41 has been made for a given recipe).

Although the above description refers to a single specific valve characteristic per batch, it will be understood that, in case of a multiple-hopper installation, a dedicated specific valve characteristic for each flow control valve is stored for each batch respectively and corrected when the respective flow control valve is used. Equivalently, identical material lots, i.e. having identical desired weight, material composition and arrangement as provided from the automated stockhouse, are considered to be different batches whenever they are stored in different hoppers of a multiple-hopper installation.

Although the proposed mode of adjusting the flow rate may be used in combination with other control procedures, in particular with a subsequent flow control that requires accurate valve characteristics, significantly reduced flow rate deviations can be achieved even when using a constant valve opening that is fixed during the entire discharge of a given batch (i.e. no "on-line" feedback control).

Gradually adjusting the flow rate as proposed, i.e. in a manner specific to each batch of a charging-cycle respectively, automatically takes into account recurring properties of the respective batch that have a secondary influence on the flow rate obtained for a given valve setting. Such properties are granulometry, initial batch weight and humidity and, in particular, material mixtures. In fact, as opposed to the conventional approach of using material-type-based characteristics, the proposed approach adapts to mixtures of plural material types within the same batch at any varying proportion without necessitating measurements for establishing a corresponding pre-determined curve.

The invention claimed is:

1. A method of adjusting a flow rate of charge material in a charging process of a shaft furnace, wherein a charging-cycle is formed of a succession of batches that are discharged into said furnace from a top hopper using a flow control valve associated to said top hopper for controlling the flow rate of charge material, the charging-cycle being associated to a recipe for control of said charging process, each batch representing a quantity of charge material that is stored intermediately in said top hopper in order to be discharged into the furnace;

pre-determined valve characteristics that represent a curve plotting flow rate against valve setting are provided for certain types of material, each pre-determined valve characteristic indicating the relation between flow rate and valve setting of said flow control valve for one type of material;

said method comprising:

storing a specific valve characteristic that represents a curve plotting flow rate against valve setting for each batch of said charging-cycle associated to said recipe respectively, each specific valve characteristic being bijectively associated to one batch of said charging-cycle associated to said recipe and indicating the relation between flow rate and valve setting of said flow control valve specifically for the associated batch, each specific valve characteristic being initialized to reflect a pre-determined valve characteristic; and at each discharge of a given batch of said charging-cycle associated to said recipe from said top hopper:

using the stored specific valve characteristic associated to said given batch for determining a requested valve setting corresponding to a flow rate setpoint and using said requested valve setting to operate said flow control valve;

determining an actual average flow rate for the discharge of said given batch;

correcting and updating the stored specific valve characteristic associated to said given batch in case there is a deviation between said flow rate setpoint and said actual average flow rate that exceeds a set minimal deviation;

so as to reduce flow rate deviation of the stored specific valve characteristic associated to said given batch at future uses of said recipe.

2. The method according to claim 1, wherein each specific valve characteristic is represented by at least a sequence of valve setting values, each valve setting value bijectively corresponding to one flow rate value, and wherein correcting the stored specific valve characteristic associated to a given batch comprises applying a respective correction term to each valve setting value of said sequence.

3. The method according to claim 2, wherein said respective correction term for a given valve setting value is determined as the result of a function which increases with the difference between said flow rate setpoint and said actual average flow rate and which decreases with the distance in terms of sequence index between said given valve setting value and the valve setting value approximating or equal to said requested valve setting.

4. The method according to claim 2, further comprising:

ensuring that said sequence of valve setting values is strictly monotonically increasing by incrementing any valve setting value that is less than or equal to the valve setting value that precedes in sequence.

5. The method according to claim 1, a stipulated deviation being a deviation comprised in the range from a minimum tolerance factor multiplied by the flow rate setpoint to a maximum tolerance factor multiplied by the flow rate setpoint.

6. The method according to claim 1, comprising for discharging a given batch from said top hopper:

using said requested valve setting to operate said flow control valve at a control valve aperture that is fixed during discharging said given batch.

7. The method according to claim 1, wherein said predetermined valve characteristics are chosen in accordance with a predominant type of material contained in the associated batch.

8. System for adjusting the flow rate of charge material in a charging installation for a shaft furnace, said installation comprising a top hopper for storing batches of a charging-cycle, the charging-cycle being associated to a recipe for control of a charging process, each batch representing a quantity of charge material that is stored intermediately in said top hopper in order to be discharged into the furnace, and a flow control valve associated to said hopper for controlling the flow rate of charge material into the furnace, said system comprising:

a data storage storing pre-determined valve characteristics, which represent a curve plotting flow rate against valve setting, for certain types of material, each pre-determined valve characteristic indicating the relation between flow rate and valve setting of said flow control valve for one type of material;

a data memory storing a specific valve characteristic that represents a curve plotting flow rate against valve setting for each batch of said charging-cycle associated to said recipe respectively, each specific valve characteristic being bijectively associated to one batch of said charging-cycle associated to said recipe and indicating the relation between flow rate and valve setting of said flow control valve specifically for the associated batch, each specific valve characteristic being initialized to reflect a pre-determined valve characteristic; and a programmable computing device programmed to execute the following at each discharge of a given batch of said charging-cycle associated to said recipe from said top hopper:

use the stored specific valve characteristic associated to said given batch for determining a requested valve setting corresponding to a flow rate setpoint and using said requested valve setting to operate said flow control valve;

determine an actual average flow rate for the discharge of said given batch;

correct and update the stored specific valve characteristic associated to said given batch in case there is a deviation between said flow rate setpoint and said actual average flow rate that exceeds a set minimal deviation;

so as to reduce flow rate deviation of the stored specific valve characteristic associated to said given batch at future uses of said recipe.

9. The system according to claim 8, wherein each specific valve characteristic is represented in said data memory by at least a sequence of valve setting values, each valve setting value bijectively corresponding to one flow rate value, and wherein said programmable computing device is programmed to correct the stored specific valve characteristic associated to a given batch by applying a respective correction term to each valve setting value of said sequence.

10. The system according to claim 9, wherein said programmable computing device is programmed to determine said respective correction term for a given valve setting value as the result of a function which increases with the difference between said flow rate setpoint and said actual average flow rate and which decreases with the distance in terms of sequence index between said given valve setting value and the valve setting value approximating or equal to said requested valve setting.

11. The system according to claim 9, wherein said programmable computing device is programmed to ensure that said sequence of valve setting values is strictly monotonically increasing by incrementing any valve setting value that is less than or equal to the valve setting value that precedes in sequence.

12. The system according to claim 8, a stipulated deviation being a deviation comprised in the range from a minimum tolerance factor multiplied by the flow rate setpoint to a maximum tolerance factor multiplied by the flow rate setpoint.

13. The system according to claim 8, said system being configured to use said requested valve setting to operate said flow control valve at a valve aperture that is fixed during discharging a given batch.

* * * * *